US011454366B2

(12) United States Patent
Zhang et al.

(10) Patent No.: US 11,454,366 B2
(45) Date of Patent: Sep. 27, 2022

(54) AUTOMOBILE LAMP LIGHTING SYSTEM, AUTOMOBILE LAMP ASSEMBLY AND AUTOMOBILE

(71) Applicant: HASCO VISION TECHNOLOGY CO., LTD., Shanghai (CN)

(72) Inventors: Jie Zhang, Shanghai (CN); Shikun Dong, Shanghai (CN); Le Xie, Shanghai (CN); Yang Liu, Shanghai (CN)

(73) Assignee: HASCO VISION TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 16/646,160

(22) PCT Filed: Apr. 10, 2018

(86) PCT No.: PCT/CN2018/082541

§ 371 (c)(1),
(2) Date: Mar. 11, 2020

(87) PCT Pub. No.: WO2019/100639

PCT Pub. Date: May 31, 2019

(65) Prior Publication Data

US 2020/0278098 A1 Sep. 3, 2020

(30) Foreign Application Priority Data

Nov. 21, 2017 (CN) ..... 201711162012.4
Nov. 21, 2017 (CN) ..... 201721558509.3

(51) Int. Cl.
*F21S 41/20* (2018.01)
*F21S 41/30* (2018.01)
(Continued)

(52) U.S. Cl.
CPC ..... *F21S 41/30* (2018.01); *F21S 41/20* (2018.01); *F21V 5/04* (2013.01); *F21V 7/04* (2013.01)

(58) Field of Classification Search
CPC ..... F21V 5/04; F21V 7/04; F21S 41/20; F21S 41/30
(Continued)

(56) References Cited

U.S. PATENT DOCUMENTS 9,945,528 B2 * 4/2018 Suwa ..... F21S 41/255
2013/0107564 A1 * 5/2013 Yatsuda ..... F21S 41/321 362/543
2016/0102831 A1 * 4/2016 Okubo ..... F21S 41/19 362/512

FOREIGN PATENT DOCUMENTS

CN 104482476 A 4/2015
CN 105929469 A 9/2016
(Continued)

*Primary Examiner* — Christopher M Raabe

(57) ABSTRACT

The present disclosure provides an automobile lamp lighting system, including a light source, a reflecting mirror, a light-shielding plate, and a lens. The lens includes a reflecting surface and a refracting surface opposite to the reflecting surface. When an external parallel light is incident into the lens, the external parallel light sequentially passes through the refracting surface for a first refraction, is reflected by the reflecting surface, passes through the refracting surface for a second refraction, exits the lens, and is converged to form a focal point. The reflecting mirror includes a near focal point and a far focal point, the light source is arranged at the near focal point, and the far focal point is located near the focal point of the lens. The light-shielding plate includes a light-shielding plate cut-off line located at the focal point of the lens.

7 Claims, 9 Drawing Sheets

(51) Int. Cl.
*F21V 5/04* (2006.01)
*F21V 7/04* (2006.01)

(58) Field of Classification Search
USPC ..... 362/487
See application file for complete search history.

(56) References Cited

FOREIGN PATENT DOCUMENTS

| | | | |
|---|---|---|---|
| CN | 106764806 | A | 5/2017 |
| CN | 206361642 | U | 7/2017 |
| CN | 107013862 | A | 8/2017 |
| CN | 107859968 | A | 3/2018 |
| JP | 2017073344 | A | 4/2017 |
| WO | WO2017082322 | A1 | 5/2017 |

* cited by examiner

AUTOMOBILE LAMP LIGHTING SYSTEM, AUTOMOBILE LAMP ASSEMBLY AND AUTOMOBILE

CROSS REFERENCES TO RELATED APPLICATIONS

This is a Sect. 371 National Stage of PCT International Application No. PCT/CN2018/082541, filed on 10 Apr. 2018, which claims priority of a Chinese Patent Application No. 201711162012.4 filed on 21 Nov. 2017, and a Chinese Patent Application No. 201721558509.3 filed on 21 Nov. 2017, the contents of the applications hereby being incorporated by reference in their entireties for all purposes.

BACKGROUND

Field of Disclosure

The present disclosure relates to the technical field of automobile lamps, in particular, to an automobile lamp lighting system, an automobile lamp assembly including the automobile lamp lighting system and an automobile including the automobile lamp assembly.

Description of Related Arts

Projection-type lighting systems commonly used in automobile lamps generally include a light source, a reflecting mirror, a light-shielding plate, and a lens. The reflecting mirror has an ellipsoidal shape. The lighting center of the light source is arranged at the vicinity of the focal point of the ellipsoidal reflecting mirror. The light emitted by the light source is reflected by the ellipsoidal reflecting mirror and is converged to the vicinity of the far focal point of the ellipsoidal reflecting mirror. The light-shielding plate is arranged at the far focal point of the ellipsoidal reflecting mirror, the shape of the light-shielding plate is consistent with the shape of the cut-off line of light and darkness required for the low beam. Finally a parallel-like low beam light pattern with a cut-off line of light and darkness is formed by passing through the lens, as shown in FIG. 1.

As shown in FIG. 2, the conventional lens is made of a plano-convex lens, the inner surface of the lens is a flat surface and arranged toward the light source, and the outer surface is an aspherical rotating curved surface. The light emitted by the light source is reflected by the reflecting mirror and is converged to the vicinity of the focal point of the plano-convex lens, then the light is emitted from the inner side of the plano-convex lens toward the outer side of the plano-convex lens, and the emitted light is close to the horizontal direction.

The patent CN101298906A discloses an automobile headlamp based on a double convex lens, the inner side surface of the double convex lens is a spherical surface and the outer side surface of double convex lens is a free-form curved surface. The light emitted by the light source is reflected by the reflecting mirror and is converged to the vicinity of the focal point of the double convex lens, then the light is emitted from the inner side of the double convex lens toward the outer side of the double convex lens, and the emitted light is close to the horizontal direction.

The above-mentioned plano-convex lens and the double convex lens change the light path by refracting the light twice, and the incident light is projected to the road surface after the light path is changed twice, which has the defects of large focal length and weak changing capability of light path.

SUMMARY

The present disclosure provides an automobile lamp lighting system, an automobile lamp assembly including the automobile lamp lighting system, and an automobile including the automobile lamp assembly. The automobile lamp lighting system has a small focal length and strong changing capability of light path, which can overcome the above-mentioned defects.

The present disclosure provides an automobile lamp lighting system, including a light source, a reflecting mirror, a light-shielding plate, and a lens. The lens includes a reflecting surface and a refracting surface opposite to the reflecting surface. When an external parallel light is incident into the lens, the external parallel light sequentially passes through the refracting surface for a first refraction, is reflected by the reflecting surface, and passes through the refracting surface for a second refraction. Then the external parallel light exits the lens and is converged to form a focal point. The reflecting mirror includes a near focal point and a far focal point, the light source is arranged at the near focal point of the reflecting mirror, and the far focal point of the reflecting mirror is located near the focal point of the lens. The light-shielding plate includes a light-shielding plate cut-off line with a same shape as a cut-off line of light and darkness of a low beam light pattern of the automobile lamp, and the light-shielding plate cut-off line is located at the focal point of the lens.

Preferably, the reflecting surface is a flat surface or a rotating curved surface.

Preferably, the refracting surface is a rotating curved surface.

Preferably, the rotating curved surface includes a rotation axis, the lens includes a plurality of the focal points, all the focal points form a focus line having the rotation axis as a center of rotation. The light-shielding plate has an arc shape matching with the focus line, and the light-shielding plate cut-off line is located at the focus line.

Preferably, a plurality of the reflecting mirror is provided, all the reflecting mirrors are arranged sequentially on a circumference having the rotation axis as a rotation center, and the far focal point of each reflecting mirror is located near the focus line of the lens, each reflecting mirror is provided with a light source correspondingly.

The present disclosure further provides an automobile lamp assembly including the above automobile lamp lighting system.

The present disclosure further provides an automobile including the above automobile lamp assembly.

The present disclosure has significant advantages: in the present disclosure, the lens has a reflecting surface, a refracting surface and a focal point. The light-shielding plate cut-off line is placed at the focal point of the lens, the far focal point of the reflecting mirror is placed near the focal point of the lens, and the light source is placed at the near focal point of the reflecting mirror. The light emitted by the light source is reflected by the reflecting mirror and is converged to the vicinity of the focal point of the lens, and is blocked by the light-shielding plate to form a suitable low beam light pattern with a cut-off line of light and darkness. Then the light is amplified and imaged to the road surface through the first refraction, the reflection and the second refraction by the lens to achieve the lighting function. The lens changes the light path through two refractions by refracting surface and one reflection by the reflecting surface, which significantly improves the changing ability of light path of the lens, and can effectively reduce the focal length of the lens, and improve the dispersion phenomenon.

Figure 1:
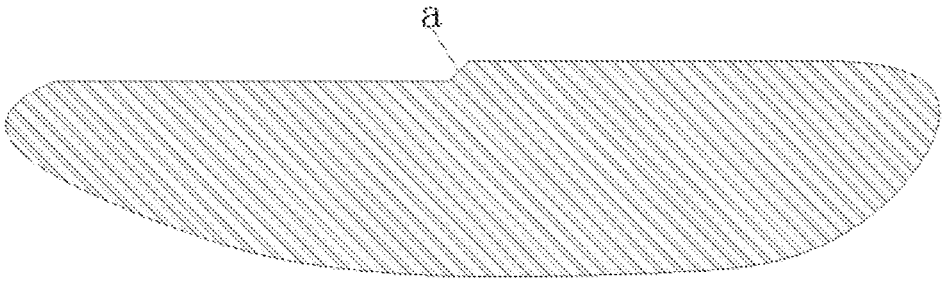
FIG. 1 is a schematic view of a low beam light pattern with a cut-off line of light and darkness.
Figure 2:
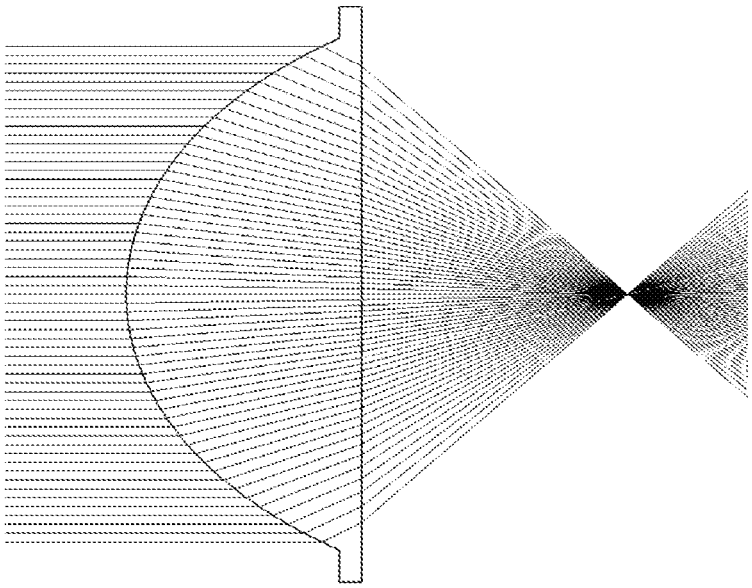
FIG. 2 is a schematic view illustrating the optical performance of a plano-convex lens in the prior art.

DESCRIPTION OF COMPONENT REFERENCE SIGNS a Cut-off line of light and darkness of low beam light pattern
b Light path of blue light
1 Light source
2, 2*a*, 2*b* Reflecting mirror
3 Light-shielding plate
4 Lens
4*a* Reflecting surface
4*b* Refracting surface
4*c* Focal point
4*d* Focus line

DETAILED DESCRIPTION OF THE PREFERRED EMBODIMENTS

The specific embodiments of the present disclosure are further described in detail below with reference to the accompanying drawings. These embodiments are only for illustrative purposes and are not to be construed as a limitation.

In the description of the present disclosure, it should be noted that the orientations or positional relationships indicated by terms "center", "longitudinal", "lateral", "upper", "lower", "front", "back", "left", "right", "vertical", "horizontal", "top", "bottom", "inside", "outside", etc. are based on the orientations or positional relationships shown in the drawings, and are only for the convenience of description of the present disclosure and simplification, rather than indicating or implying that the device or element referred to must have a particular orientation, be constructed and operate in a particular orientation, and therefore should not be construed as limiting the present disclosure. Moreover, the terms "first" and "second" are used for descriptive purposes only and are not to be construed as indicating or implying relative importance.

In the description of the present disclosure, it should be noted that the terms "installation", "connected", and "coupled" are to be understood broadly. For example, it can be fixed or detachable connected, or integrally connected; it can be mechanical or electrical connected; it can be directly connected, or indirectly connected through an intermediate medium, it can be the internal communication of two components. For those skilled in the art, the specific meanings of the above terms in the present disclosure can be understood on a case-by-case basis.

Further, in the description of the present disclosure, the meaning of "a plurality" is two or more unless otherwise specified.

FIGS. 3-14 show an embodiment of the automobile lamp lighting system of the present disclosure.

Figure 3:
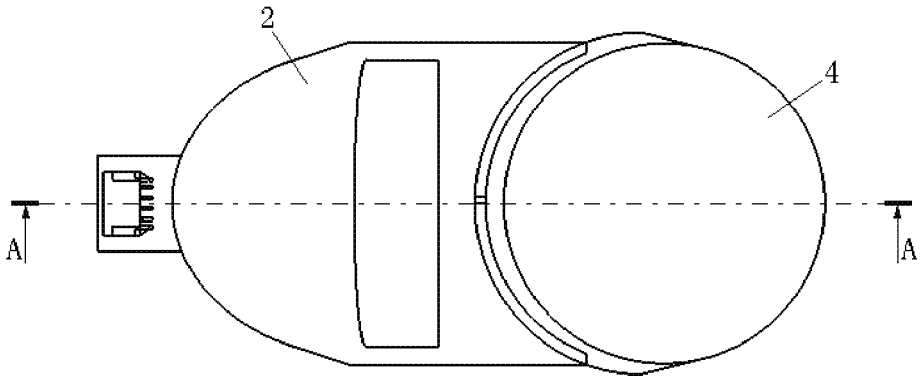
FIG. 3 is a top view of an automobile lamp lighting system in the present disclosure.
Figure 4:
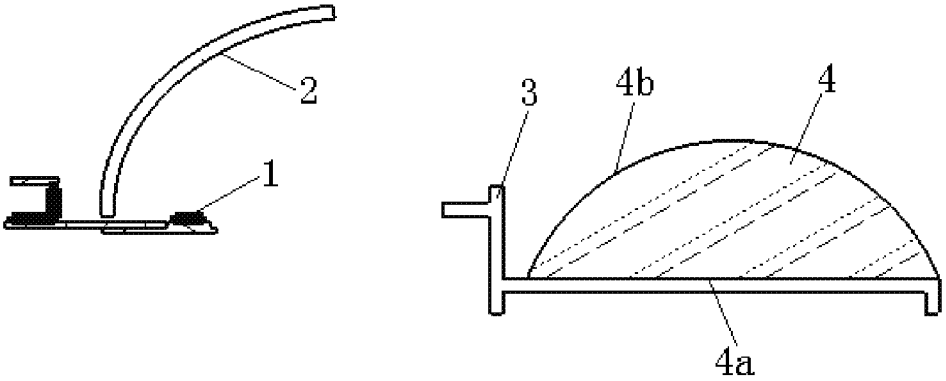
FIG. 4 is a cross-sectional view taken along line A-A in FIG. 3.

As shown in FIGS. 3-4, the automobile lamp lighting system of the present disclosure includes a light source 1, a reflecting mirror 2, a light-shielding plate 3, and a lens 4.

Figure 5:
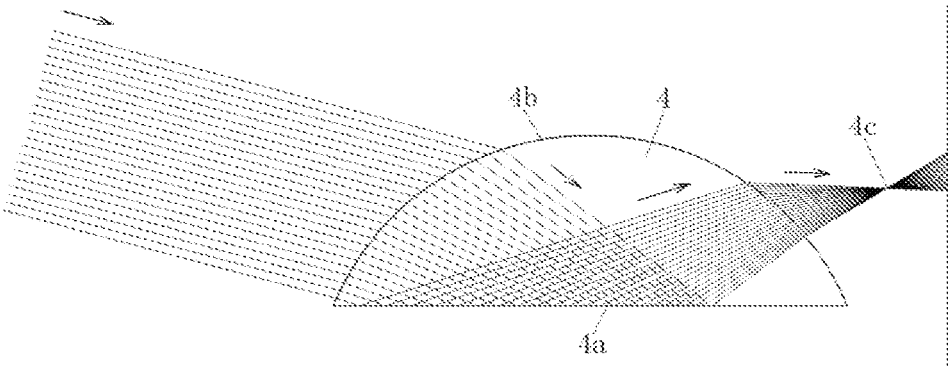
FIG. 5 is a schematic illustration of the optical performance of a lens in the embodiment of the present disclosure.

As shown in FIG. 5, the lens 4 of the present embodiment includes a reflecting surface 4*a* and a refracting surface 4*b* opposite to the reflecting surface 4*a*. When an external parallel light is incident into the lens 4, the external parallel light sequentially passes through the refracting surface 4*b* for a first refraction, is reflected by the reflecting surface 4*a*, and passes through the refracting surface 4*b* for a second refraction, then the external parallel light exits the lens 4 and is converged to form a focal point 4*c*. According to the principle that the light path is reversible, the light emitted from the focal point 4*c* is incident into the lens 4, and also sequentially passes through the refracting surface 4*b* for a first refraction, is reflected by the reflecting surface 4*a*, and passes through the refracting surface 4*b* for a second refraction, then the light exits the lens 4, and forms a parallel-like light. In this embodiment, the incident light can be totally reflected on the reflecting surface 4*a* of the lens 4.

Figure 6:
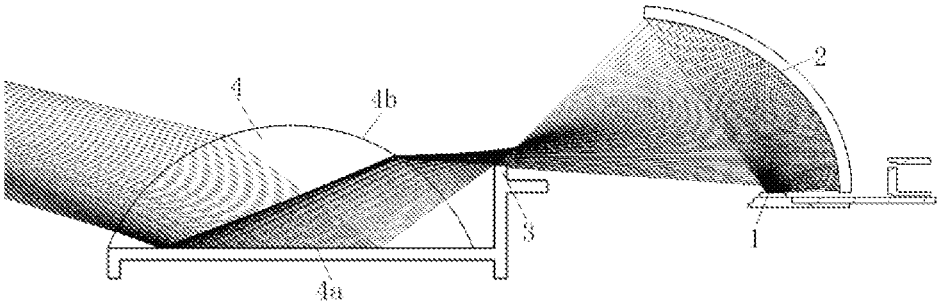
FIG. 6 is a schematic view illustrating the light path of an automobile lamp lighting system in the embodiment of the present disclosure.

As shown in FIG. 6, in the present embodiment, the reflecting surface of the reflecting mirror 2 is an ellipsoid-like surface, so the mirror 2 has a near focal point and a far focal point. The light source 1 is arranged at the near focal point of the reflecting mirror 2, the far focal point of the reflecting mirror 2 is arranged near the focal point 4*c* of the lens 4. The light-shielding plate 3 includes a light-shielding plate cut-off line with a same shape as a cut-off line of light and darkness of a low beam light pattern of the automobile lamp, and the light-shielding plate cut-off line is located at the focal point 4*c* of the lens 4, for blocking the light and forming the clear cut-off line of light and darkness a of the low beam light pattern. Thereby, the light emitted by the light source 1 is reflected by the reflecting surface of the mirror 2 and then is converged to the far focal point of the mirror 2. That is, the light is converged to vicinity of the focal point 4*c* of the lens 4, and is blocked by the light-shielding plate 3 to form a desired low beam light pattern with a cut-off line of light and darkness a, and then is incident into the lens 4. After the first refraction made by the refracting surface 4*b* of the lens 4, the reflection made by the reflecting surface 4*a*, and the second refraction made by the refracting surface 4*b*, the light is amplified and imaged onto the road surface to achieve the lighting function. In the present embodiment, the lens 4 changes the light path through two refractions made by the refracting surface 4*b* and one reflection made by the reflecting surface 4*a*, which significantly improves the light path changing ability of the lens 4, effectively reduces the focal length of the lens 4, and improves the dispersion phenomenon.

Figure 7:
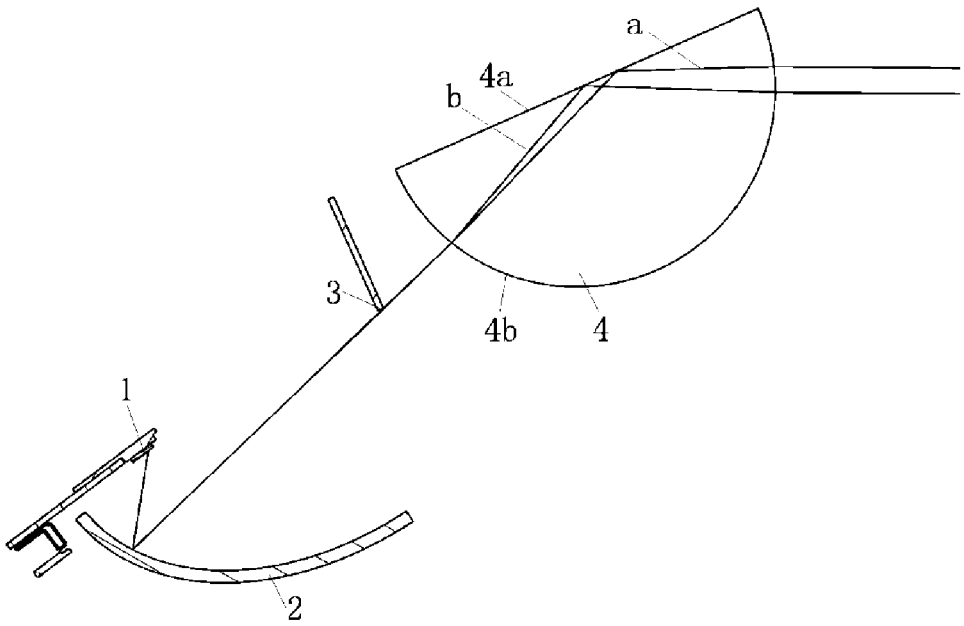
FIG. 7 is a schematic view of a light path of an automobile lamp lighting system near the cut-off line of light and darkness in the embodiment of the present disclosure.

The conventional light source of the lighting system of the automobile lamp usually uses white LEDs (Light Emitting Diode) as light emitting chip, and the highest energy of the light emitted by the light source is blue light, and the refractive index of the blue light is higher in the same medium, thereby the cut-off line of light and darkness of the low beam light pattern is prone to be blue due to dispersion, and the bottom of the low beam light pattern is prone to have obvious colorful dispersion phenomenon. The automobile lamp lighting system of the present embodiment changes the light path through two refractions made by the refracting surface 4*b* of the lens 4 and one reflection made by the reflecting surface 4*a*. FIG. 7 shows a blue light path b at the cut-off line of light and darkness a of the automobile lamp lighting system in the present embodiment. It can be seen that after the light passes through the refracting surface 4*b* for the first refraction, the blue light path b is located above the cut-off line of light and darkness a because the blue light has a high refractive index. But after being reflected by the reflecting surface 4*a*, the blue light path b is located below the cut-off line of light and darkness a, and emits to the illuminating area. Therefore, the problem of being blue at the cut-off line of light and darkness a can be greatly improved, the formed cut-off light of light and darkness a of the low beam light pattern is not noticeably blue, and there is no obvious dispersion phenomenon at the bottom of the low beam light pattern. Therefore, it can be concluded that, after two refractions made by the refracting surface 4*b* of the lens 4 and one reflection made by the reflecting surface 4*a*, the light path of the automobile lamp lighting system of the present embodiment can greatly reduce the dispersion and effectively improve the dispersion phenomenon of the low beam light pattern. It solves the problem that the cut-off line of light and darkness a of the low beam light pattern is blue and the dispersion problem at the bottom of the low beam light pattern, which is unavoidable for the projected low beam modules in the industry and has not been solved.

In this embodiment, the reflecting surface 4*a* of the lens 4 may be a flat surface or a rotating curved surface, and the rotating curved surface may be a spherical surface or an aspherical surface.

Figure 8:
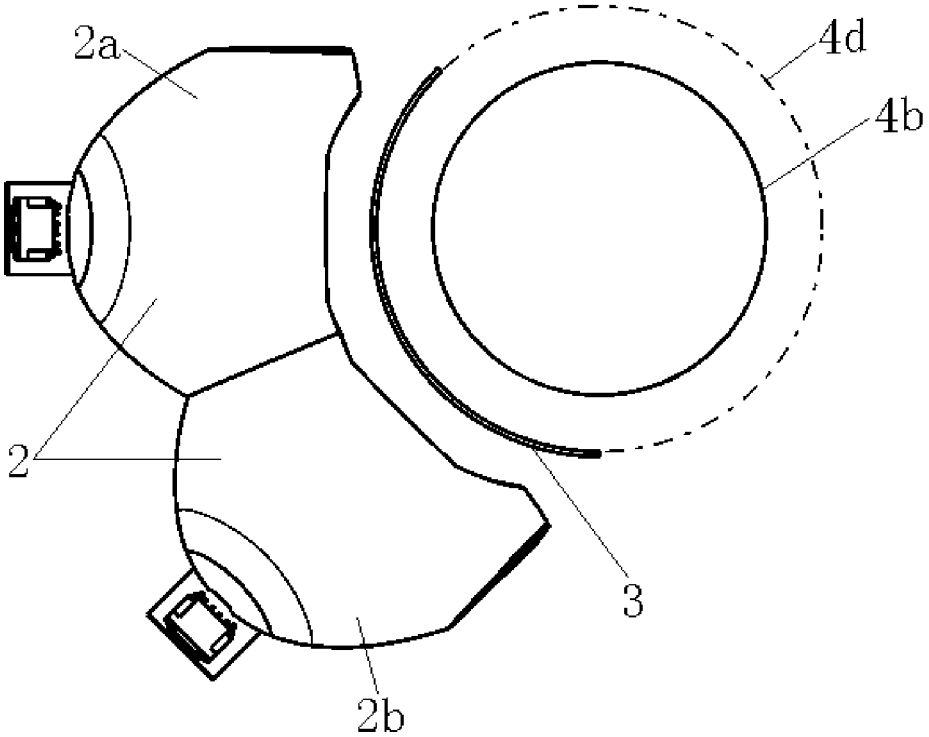
FIG. 8 is a schematic structural view of an automobile lamp lighting system with two light sources and reflecting mirrors in the embodiment of the present disclosure.

As shown in FIG. 8, in the present embodiment, the refracting surface 4*b* of the lens 4 is a rotating curved surface, and the rotating curved surface may be a spherical surface or an aspherical surface having a rotating axis. The lens 4 has a plurality of focal points 4*c*, and all the focal points 4*c* form a focus line 4*d*, whose center of rotation is the rotation axis of the refracting surface 4*b*. The light-shielding plate 3 has an arc shape matching with the focus line 4*d* of the lens 4, and the light-shielding plate cut-off line of the light-shielding plate 3 is located at the focus line 4*d* of the lens 4. Thus, the reflecting mirror 2 can be arranged in plurality, all the reflecting mirrors 2 are sequentially arranged on a circumference whose center of rotation is the rotation axis of the refracting surface 4*b*, the far focal point of each reflecting mirror 2 is located near the focus line 4*d* of the lens 4, and each reflecting mirror 2 includes a light source 1 correspondingly. The light emitted by each light source 1 can be reflected by the corresponding reflecting mirror 2 and converged to the vicinity of the focus line 4*d* of the lens 4, is blocked by the light-shielding plate 3 to form a light pattern with the cut-off line of light and darkness a, and then is incident into the lens 4. After the first refraction made by the refracting surface 4*b* of the lens 4, the reflection made by the reflecting surface 4*a*, and the second refraction made by the refracting surface 4*b*, the light is amplified and imaged onto the road surface to achieve the lighting function.

Figure 9:
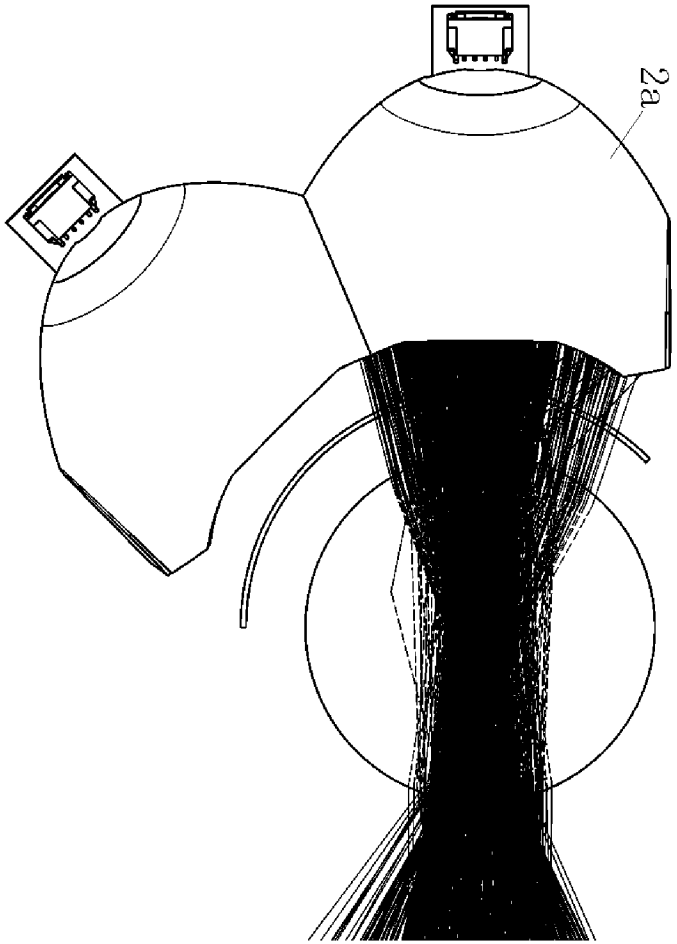
FIG. 9 is a schematic view illustrating the light path of a light source in FIG. 8.
Figure 10:
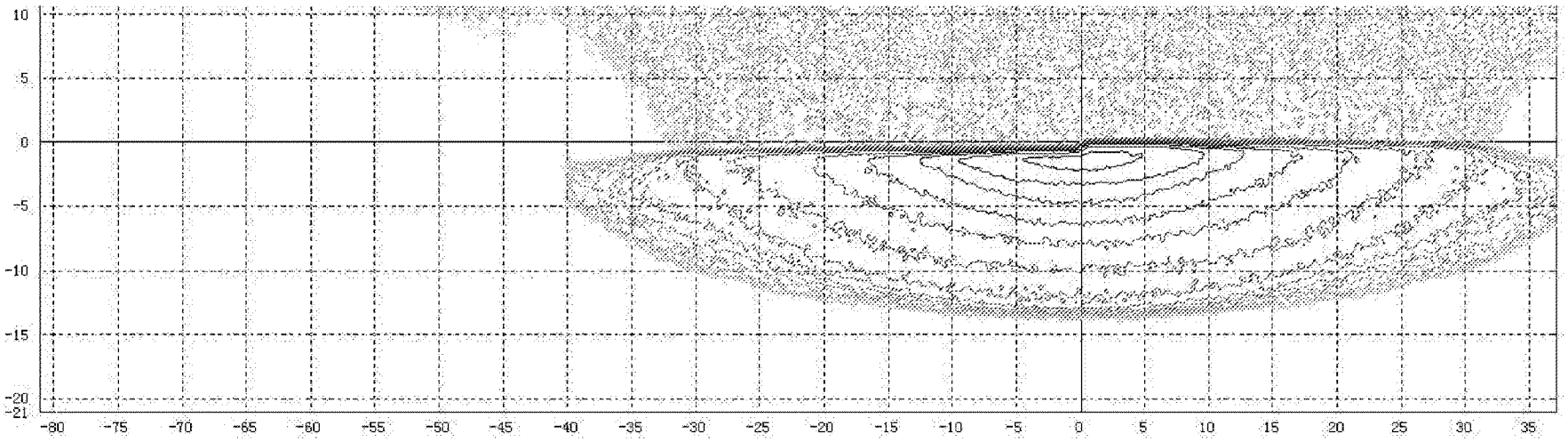
FIG. 10 is a schematic simulation diagram of the illumination light pattern formed by the light emitted from the light sources in FIG. 8.
Figure 11:
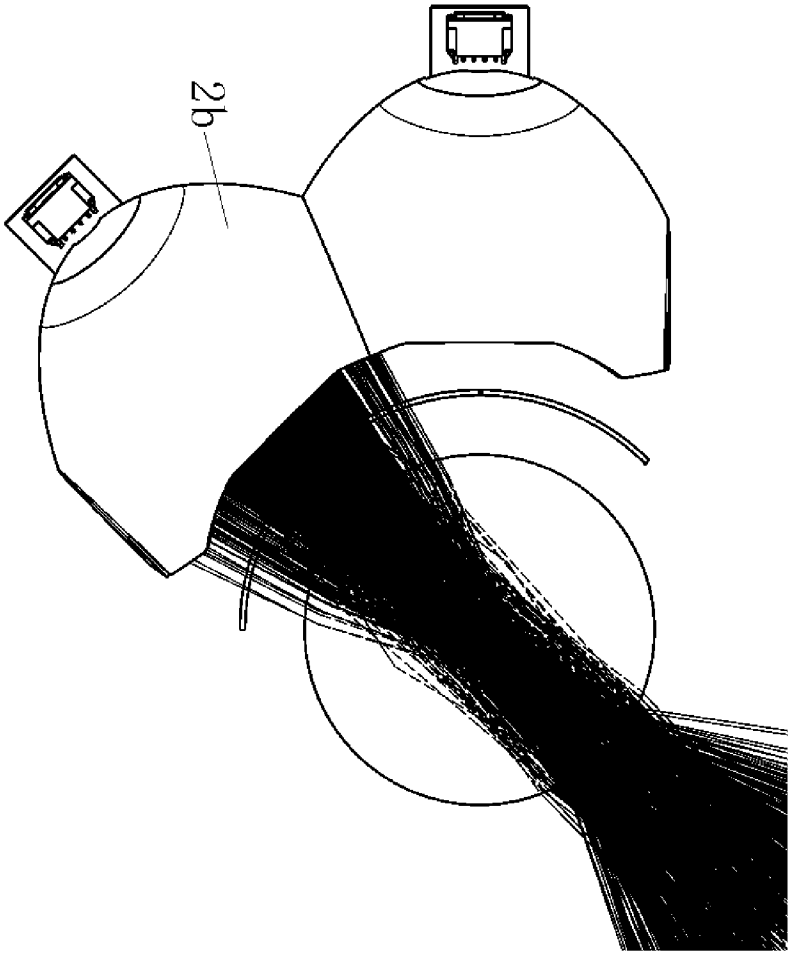
FIG. 11 is a schematic view illustrating the light path of another light source in FIG. 8.
Figure 12:
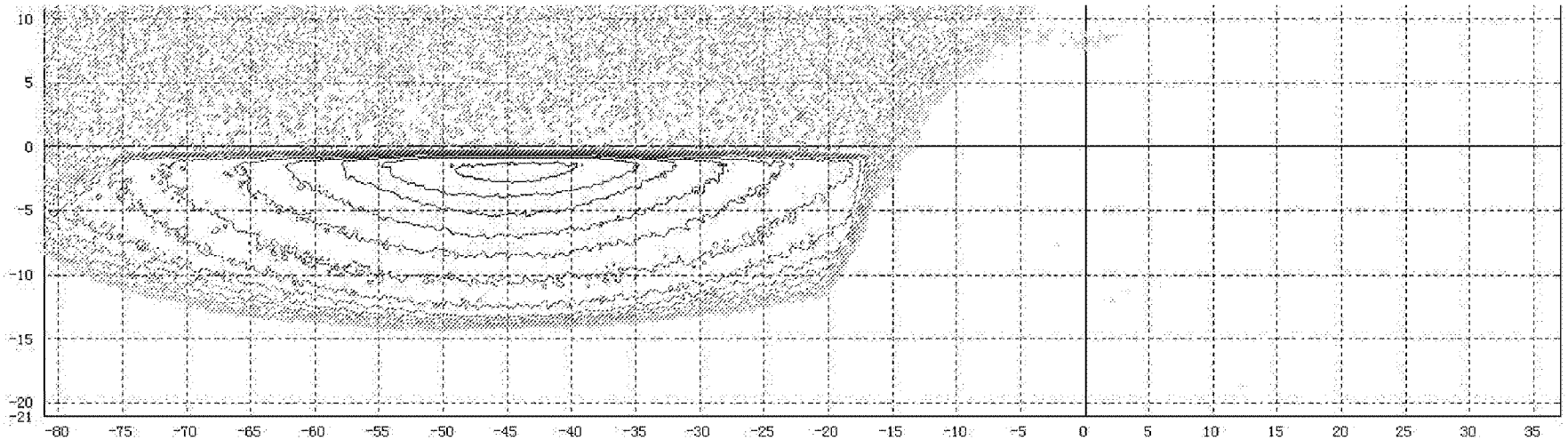
FIG. 12 is a schematic simulation diagram of the illumination light pattern formed by the light emitted by the light source in FIG. 8.
Figure 13:
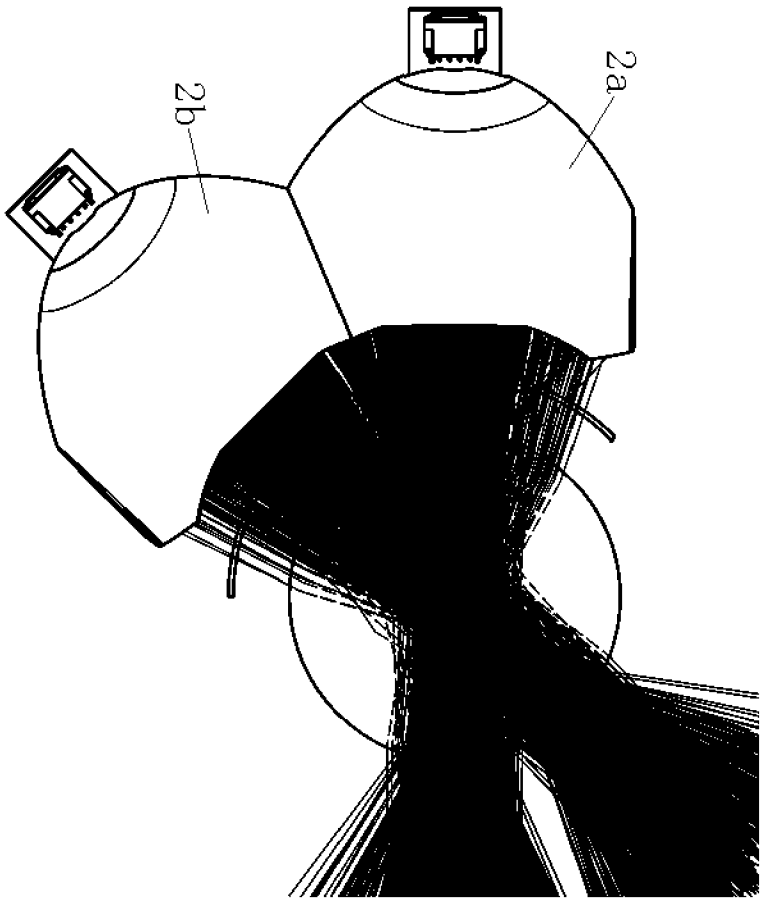
FIG. 13 is a schematic view of the light path of the two light sources illuminating simultaneously in FIG. 8.
Figure 14:
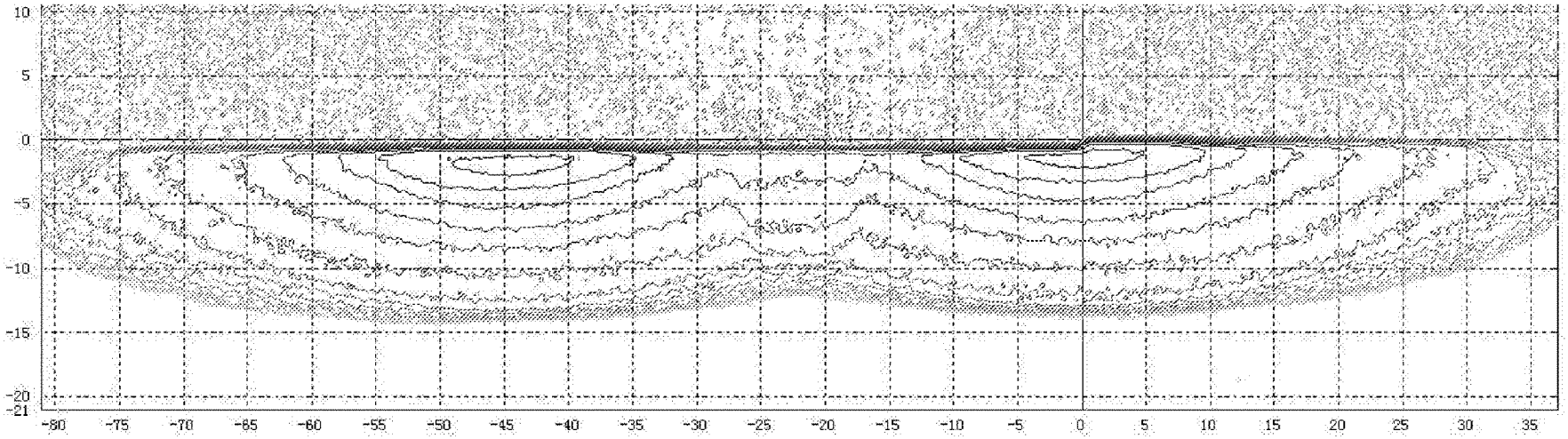
FIG. 14 is a schematic simulation diagram of the illumination light pattern formed by the two light sources illuminating simultaneously in FIG. 8.

For example, as shown in FIG. 8 in this embodiment, two reflecting mirrors 2 may be arranged, and each of the two reflecting mirrors 2 is correspondingly provided with a light source 1. FIG. 9 is a schematic diagram showing a light path of the corresponding light source of the reflecting mirror 2*a*. FIG. 10 is a schematic diagram showing the illumination light pattern formed by the light source corresponding to the reflecting mirror 2*a*, and the illumination light pattern can be used as a low beam illumination light pattern. FIG. 11 is a schematic view showing a light path of a light source corresponding to the reflecting mirror 2*b*. FIG. 12 is a schematic diagram showing an illumination light pattern formed by the light source corresponding to the reflecting mirror 2*b*, and the illumination light pattern can be used as a bend illumination light pattern. FIG. 13 is a schematic diagram showing a light path of a light source corresponding to the reflecting mirror 2*a* and the reflecting mirror 2*b*. FIG. 14 is a schematic diagram showing an illumination light pattern formed by the light source corresponding to the reflecting mirror 2*a* and the reflecting mirror 2*b* emitting light simultaneously, and the illumination light pattern can be used as both the low beam illumination light pattern and the bend illumination light pattern.

The range of low beam lighting of the conventional automobile lighting system is generally ±40° in the front direction of the automobile. To achieve the high-angle bend lighting, a bend lighting system has to be additionally added to the automobile for high-angle lighting compensation when the automobile turns. In the automobile lamp lighting system of the present embodiment, by arranging a plurality of reflecting mirrors 2 and light sources 1 on the circumference whose center of rotation is the rotation axis of the refracting surface 4*b* of the lens 4, the lighting range of the low beam light pattern can be expanded, even the bend lighting function is achieved, so that no additional bend lighting system is needed, and the overall structure of the automobile lamp can be simplified. Moreover, since the cut-off lines of light and darkness are formed by the same light-shielding plate 3 for the low beam and bend lighting functions, the inherent defect that the cut-off lines of light and darkness are hard to be arranged at the same level in the upper and lower directions due to the manufacture or assembly errors of components of the conventional split-type bend lighting system is avoided. Furthermore, each reflecting mirror 2 of the present embodiment may only be provided with one single light source 1 correspondingly, and the low beam lighting function is achieved by emitting light simultaneously through multiple or all the light sources 1, thereby dispersing multiple light sources that must be concentrated in one place in a conventional arrangement, which increases the low beam lighting angle, avoids the problem of difficult heat dissipation caused by concentrated heat generation when multiple light sources are in operation, and avoids the problem of poor focus of the reflecting mirror and difficult control of the light pattern caused by the larger light emitting area.

The present embodiment further provides an automobile lamp assembly according to the above-described automobile lamp lighting system. The automobile lamp assembly includes the above automobile lamp lighting system.

According to the above automobile lamp assembly, the present embodiment further provides an automobile, the automobile includes the above automobile lamp assembly.

In summary, in the automobile lamp lighting system, the automobile lamp assembly including the automobile lamp lighting system, and the automobile including the automobile lamp assembly in the present embodiment, the lens 4 includes a reflecting surface 4*a*, a refracting surface 4*b*, and a focal point. The cut-off line of the light-shielding plate 3 is placed at the focal point of the lens 4, the far focal point of the reflecting mirror 2 is placed near the focal point of the lens 4, and the light source 1 is placed at the near focal point of the reflecting mirror 2. The light emitted by the light source 1 is reflected by the reflecting mirror 2, is converged to the vicinity of the focal point of the lens 4, and is blocked by the light-shielding plate 3 to form a desired low beam light pattern with a cut-off line of light and darkness. Then the light is amplified and imaged onto the road surface to achieve the lighting function through the first refraction, the reflection and the second refraction by the lens 4. The lens 4 changes the light path through two refractions of the light by the refracting surface 4*b* and a reflection of the light by the reflecting surface 4*a*, thereby significantly improving the light path changing ability of the lens 4, effectively reducing the focal length of the lens 4, and improving the dispersion phenomenon.

The above is only a preferred embodiment of the present disclosure, and it should be noted that those skilled in the art can make several improvements and substitutions without departing from the technical principles of the present disclosure. It should also be considered as the scope of protection of the present disclosure.

We claim:

1. An automobile lamp lighting system, comprising a light source (1), a reflecting mirror (2, 2*a*, 2*b*), a light-shielding plate (3), and a lens (4); wherein the lens (4) comprises a reflecting surface (4*a*) and a refracting surface (4*b*) opposite to the reflecting surface (4*a*);

when an external parallel light is incident into the lens (4), the external parallel light sequentially passes through the refracting surface (4*b*) for a first refraction, is reflected by the reflecting surface (4*a*), and passes through the refracting surface (4*b*) for a second refraction, then the external parallel light exits the lens (4) and is converged to form a focal point (4*c*);

the reflecting mirror (2, 2*a*, 2*b*) includes a near focal point and a far focal point, the light source (1) is arranged at the near focal point of the reflecting mirror (2, 2*a*, 2*b*), and the far focal point of the reflecting mirror (2, 2*a*, 2*b*) is located near the focal point (4*c*) of the lens (4); and the light-shielding plate (3) includes a light-shielding plate cut-off line with a same shape as a cut-off line of light and darkness (a) of a low beam light pattern of the automobile lamp, and the light-shielding plate cut-off line is located at the focal point (4*c*) of the lens (4).

2. The automobile lamp lighting system according to claim 1, wherein the reflecting surface (4*a*) is a flat surface or a rotating curved surface.

3. The automobile lamp lighting system according to claim 1, wherein the refracting surface (4*b*) is a rotating curved surface.

4. The automobile lamp lighting system according to claim 3, wherein the rotating curved surface includes a rotation axis;

the lens (4) includes a plurality of the focal points (4*c*), all the focal points (4*c*) form a focus line (4*d*) having the rotation axis as a center of rotation; and the light-shielding plate (3) has an arc shape matching with the focus line (4*d*), and the light-shielding plate cut-off line is located at the focus line (4*d*).

5. The automobile lamp lighting system according to claim 4, wherein a plurality of the reflecting mirror (2, 2*a*, 2*b*) is provided, all the reflecting mirrors (2, 2*a*, 2*b*) are arranged sequentially on a circumference having the rotation axis as a rotation center;

the far focal point of each reflecting mirror (2, 2*a*, 2*b*) is located near the focus line (4*d*) of the lens (4); and each reflecting mirror (2, 2*a*, 2*b*) is provided with a light source (1) correspondingly.

6. An automobile lamp assembly, comprising an automobile lamp lighting system, the automobile lamp lighting system comprises a light source (1), a reflecting mirror (2, 2*a*, 2*b*), a light-shielding plate (3), and a lens (4); wherein the lens (4) comprises a reflecting surface (4*a*) and a refracting surface (4*b*) opposite to the reflecting surface (4*a*);

when an external parallel light is incident into the lens (4), the external parallel light sequentially passes through the refracting surface (4*b*) for a first refraction, is reflected by the reflecting surface (4*a*), and passes through the refracting surface (4*b*) for a second refraction, then the external parallel light exits the lens (4) and is converged to form a focal point (4*c*);

the reflecting mirror (2, 2*a*, 2*b*) includes a near focal point and a far focal point, the light source (1) is arranged at the near focal point of the reflecting mirror (2, 2*a*, 2*b*), and the far focal point of the reflecting mirror (2, 2*a*, 2*b*) is located near the focal point (4*c*) of the lens (4); and the light-shielding plate (3) includes a light-shielding plate cut-off line with a same shape as a cut-off line of light and darkness (a) of a low beam light pattern of the automobile lamp, and the light-shielding plate cut-off line is located at the focal point (4*c*) of the lens (4).

7. An automobile, comprising an automobile lamp assembly, the automobile lamp assembly comprises an automobile lamp lighting system, the automobile lamp lighting system comprises a light source (1), a reflecting mirror (2, 2*a*, 2*b*), a light-shielding plate (3), and a lens (4); wherein the lens (4) comprises a reflecting surface (4*a*) and a refracting surface (4*b*) opposite to the reflecting surface (4*a*);

when an external parallel light is incident into the lens (4), the external parallel light sequentially passes through the refracting surface (4*b*) for a first refraction, is reflected by the reflecting surface (4*a*), and passes through the refracting surface (4*b*) for a second refraction, then the external parallel light exits the lens (4) and is converged to form a focal point (4*c*);

the reflecting mirror (2, 2*a*, 2*b*) includes a near focal point and a far focal point, the light source (1) is arranged at the near focal point of the reflecting mirror (2, 2*a*, 2*b*), and the far focal point of the reflecting mirror (2, 2*a*, 2*b*) is located near the focal point (4*c*) of the lens (4); and the light-shielding plate (3) includes a light-shielding plate cut-off line with a same shape as a cut-off line of light and darkness (a) of a low beam light pattern of the automobile lamp, and the light-shielding plate cut-off line is located at the focal point (4*c*) of the lens (4).

* * * * *